US008878634B2

(12) United States Patent
Yoshikawa et al.

(10) Patent No.: US 8,878,634 B2
(45) Date of Patent: Nov. 4, 2014

(54) BANDPASS FILTER, AND WIRELESS COMMUNICATION MODULE AND WIRELESS COMMUNICATION DEVICE USING THE BANDPASS FILTER

(75) Inventors: Hiromichi Yoshikawa, Kirishima (JP); Masafumi Horiuchi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 764 days.

(21) Appl. No.: 13/131,236

(22) PCT Filed: Nov. 24, 2009

(86) PCT No.: PCT/JP2009/069792

§ 371 (c)(1),
(2), (4) Date: May 25, 2011

(87) PCT Pub. No.: WO2010/061815

PCT Pub. Date: Jun. 3, 2010

(65) Prior Publication Data

US 2011/0237216 A1 Sep. 29, 2011

(30) Foreign Application Priority Data

Nov. 26, 2008 (JP) ..... 2008-300730
Feb. 25, 2009 (JP) ..... 2009-041983

(51) Int. Cl.
*H01P 1/203* (2006.01)
*H01P 7/08* (2006.01)

(52) U.S. Cl.
CPC ..... *H01P 1/20345* (2013.01); *H01P 7/08* (2013.01)
USPC ..... 333/204; 333/219

(58) Field of Classification Search
CPC ..... H01P 1/20345; H01P 7/08
USPC ..... 333/204, 205, 219
See application file for complete search history.

(56) References Cited

U.S. PATENT DOCUMENTS 5,489,881 A 2/1996 Yuda et al.
5,832,578 A 11/1998 Yuda et al.
(Continued)

FOREIGN PATENT DOCUMENTS

JP 7-30303 A 1/1995
JP 8-70201 A 3/1996
(Continued)

*Primary Examiner* — Robert Pascal
*Assistant Examiner* — Gerald Stevens
(74) *Attorney, Agent, or Firm* — Volpe and Koenig, P.C.

(57) ABSTRACT

[Object] An object is to provide a bandpass filter that can be used for a wide frequency band and has a large degree of freedom in designing a passband, and a wireless communication module and a wireless communication device that use the bandpass filter.

[Solution] A bandpass filter includes first to third resonance electrodes 31*a*, 31*b*, and 31*c* sequentially arranged side-by-side such that they are electromagnetically coupled to each other, the first to third resonance electrodes 31*a*, 31*b*, and 31*c* being grounded at one end and constituting first to third resonators, respectively; a first input/output coupling electrode 40*a* facing the first resonance electrode 31*a* and electromagnetically coupled thereto; a second input/output coupling electrode 40*b* facing the second resonance electrode 31*b* and electromagnetically coupled thereto; and a resonator coupling electrode 43 configured to provide electromagnetic coupling between the first resonance electrode 31*a* and the third resonance electrode 31*c*. The first and second resonators have the same resonance frequency which is different from a resonance frequency of the third resonator. The first to third resonators are used to produce a passband. The bandpass filter can be used for a wide frequency band and has a large degree of freedom in designing the passband.

7 Claims, 21 Drawing Sheets

(56) References Cited

U.S. PATENT DOCUMENTS

| | | | | |
|---|---|---|---|---|
| 6,294,967 | B1 * | 9/2001 | Hirai et al. | 333/202 |
| 2003/0085780 | A1 * | 5/2003 | Wang | 333/204 |
| 2006/0255885 | A1 * | 11/2006 | Yoshikawa et al. | 333/204 |
| 2009/0140827 | A1 | 6/2009 | Yoshikawa | |
| 2010/0033271 | A1 * | 2/2010 | Ninomiya et al. | 333/204 |
| 2010/0073108 | A1 * | 3/2010 | Yamasita et al. | 333/204 |

FOREIGN PATENT DOCUMENTS

| | | | | | |
|---|---|---|---|---|---|
| JP | 2006-33614 | A | | 2/2006 | |
| JP | 2006-166136 | A | | 6/2006 | |
| JP | WO 2008/066198 | | * | 6/2008 | H01P 1/203 |
| JP | 2008-271485 | A | | 11/2008 | |
| JP | WO 2008/132927 | | * | 11/2008 | H01P 1/203 |
| JP | 2009-105865 | A | | 5/2009 | |

* cited by examiner

BANDPASS FILTER, AND WIRELESS COMMUNICATION MODULE AND WIRELESS COMMUNICATION DEVICE USING THE BANDPASS FILTER

TECHNICAL FIELD

The present invention relates to a bandpass filter that can be used for a wide frequency band and has a large degree of freedom in designing a passband, and further relates to a wireless communication module and a wireless communication device that use the bandpass filter.

BACKGROUND ART

In an electronic apparatus, such as a communication device, a bandpass filter that passes electric signals of only specific frequencies is used. In particular, a bandpass filter is widely used, which forms a passband including an even-mode resonance frequency and an odd-mode resonance frequency by using even mode resonance and odd mode resonance in a resonance system in which two resonators having the same resonance frequency are electromagnetically coupled to each other. In this bandpass filter, a difference between the even-mode resonance frequency and the odd-mode resonance frequency varies depending on the strength of electromagnetic coupling between the two resonators. The passband width of the bandpass filter is thus determined (see, e.g., Patent Literature (PTL) 1).

CITATION LIST

Patent Literature

PTL 1: Japanese Unexamined Patent Application Publication No. 7-30303

SUMMARY OF INVENTION

Technical Problem

However, since the above-described bandpass filter of the related art forms a passband using two resonance peaks which are an even-mode resonance peak and an odd-mode resonance peak, there are limitations in using the bandpass filter for a wide frequency band. Another bandpass filter is also known, which forms a passband by using three resonance peaks of three resonance modes in a resonance system in which three resonators having the same resonance frequency are electromagnetically coupled to each other. This bandpass filter can be used for a wider frequency band. However, since it is difficult to individually set the frequencies of three resonance peaks to any values, the degree of freedom in designing the passband is small.

The present invention has been devised in view of the problems with the related art described above. An object of the present invention is to provide a bandpass filter that can be used for a wide frequency band and has a large degree of freedom in designing a passband, and also to provide a wireless communication module and a wireless communication device that use the bandpass filter.

Solution to Problem

A bandpass filter according to the present invention includes a laminated body formed by stacking a plurality of dielectric layers; a ground electrode disposed on at least one of an upper surface and a lower surface of the laminated body; first to third resonance electrodes having a strip shape and sequentially arranged side-by-side, as viewed in the stacking direction, on the same interlayer or different interlayers of the laminated body such that the first to third resonance electrodes are electromagnetically coupled to each other, the first to third resonance electrodes being grounded at one end and constituting first to third resonators, respectively; a first input/output coupling electrode having a strip shape and disposed in an interlayer of the laminated body, the interlayer being different from the interlayer where the first resonance electrode is disposed, such that the first input/output coupling electrode faces the first resonance electrode and is electromagnetically coupled thereto; a second input/output coupling electrode having a strip shape and disposed in an interlayer of the laminated body, the interlayer being different from the interlayer where the second resonance electrode is disposed, such that the second input/output coupling electrode faces the second resonance electrode and is electromagnetically coupled thereto; and a resonator coupling electrode disposed in an interlayer of the laminated body, the interlayer being different from both the interlayer where the first resonance electrode is disposed and the interlayer where the third resonance electrode is disposed, and configured to provide electromagnetic coupling between the first resonance electrode and the third resonance electrode. The first and second resonators have the same resonance frequency which is different from a resonance frequency of the third resonator. The first to third resonators are used to produce a passband.

In the bandpass filter of the present invention, in the configuration described above, the first to third resonance electrodes may be disposed in the same interlayer of the laminated body.

In the bandpass filter of the present invention, in the configuration described above, the ground electrode may be disposed on the lower surface of the laminated body; the first and third resonance electrodes may be spaced side-by-side on a first interlayer of the laminated body; and the second resonance electrode may be disposed in a second interlayer of the laminated body, the second interlayer being above the first interlayer, such that the second resonance electrode is located between the first and third resonance electrodes as viewed in the stacking direction.

In the bandpass filter of the present invention, in any of the configurations described above, the first to third resonance electrodes may be disposed such that the grounded ends thereof are inter-digitally arranged as viewed in the direction substantially orthogonal to the laminated body, the first resonance electrode and the third resonance electrode may be electromagnetically coupled mainly capacitively to each other through the resonator coupling electrode, and the resonance frequency of the first and second resonators may be set to be higher than the resonance frequency of the third resonator.

In the bandpass filter of the present invention, in any of the configurations described above, the first to third resonance electrodes may be disposed such that the grounded ends thereof are inter-digitally arranged as viewed in the direction substantially orthogonal to the laminated body, the first resonance electrode and the third resonance electrode may be electromagnetically coupled mainly inductively to each other through the resonator coupling electrode, and the resonance frequency of the first and second resonators may be set to be lower than the resonance frequency of the third resonator.

A wireless communication module according to the present invention includes an RF unit including the bandpass filter according to any one of the configurations described above, and a baseband unit connected to the RF unit.

A wireless communication device according to the present invention includes an RF unit including the bandpass filter according to any one of the configurations described above, a baseband unit connected to the RF unit, and an antenna connected to the RF unit.

Advantageous Effects of Invention

In the bandpass filter according to the present invention having the configuration described above, two resonance peaks of an even mode and an odd mode are formed by electromagnetic coupling between the first and second resonators that are adjacent and have the same resonance frequency. Additionally, the third resonance peak is formed by direct electromagnetic coupling of the third resonator having a resonance frequency different from that of the first and second resonators to the second resonator and, at the same time, by electromagnetic coupling of the third resonator through the resonator coupling electrode to the first resonator. Thus, since these three resonance peaks can be used to produce a passband, a bandpass filter for a wide frequency band can be realized. Moreover, since frequencies of the three resonance peaks can be set to any values, a bandpass filter having a large degree of freedom in designing a passband can be realized.

DESCRIPTION OF EMBODIMENTS

A bandpass filter, and a wireless communication module and a wireless communication device that use the bandpass filter according to the present invention will now be described in detail with reference to the attached drawings.

First Embodiment

Figure 1:
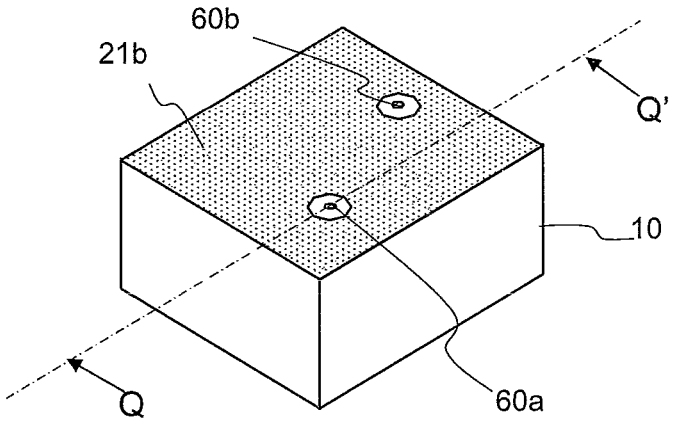
FIG. 1 is an external perspective view schematically illustrating a bandpass filter according to a first embodiment of the present invention.
Figure 2:
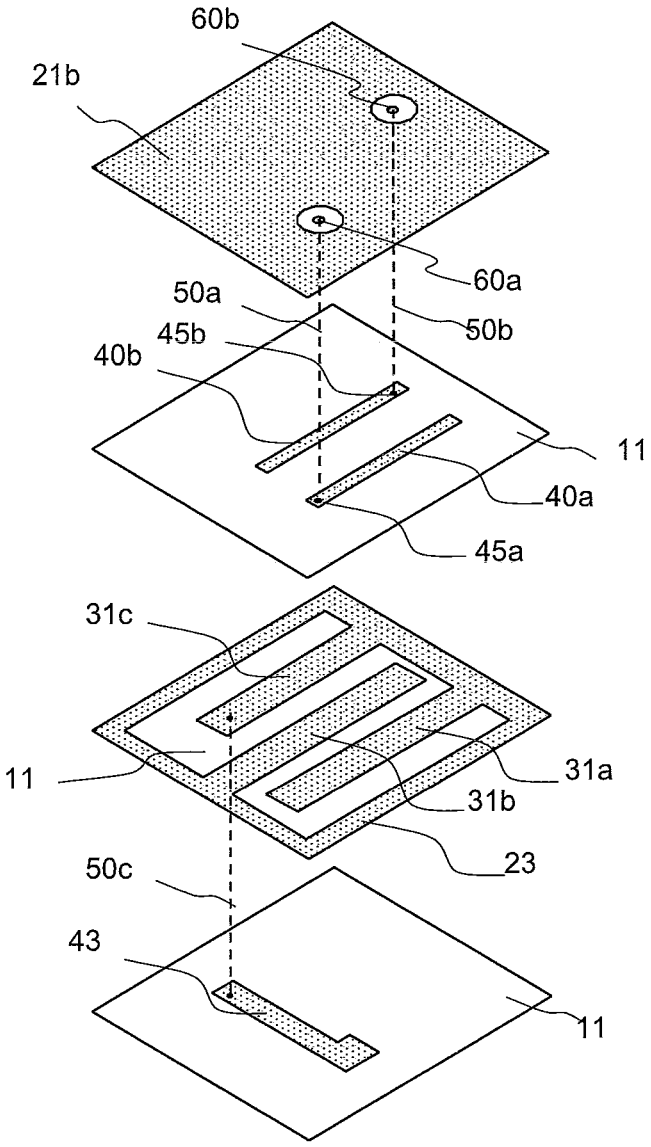
FIG. 2 is a schematic exploded perspective view of the bandpass filter illustrated in FIG. 1.
Figure 3:
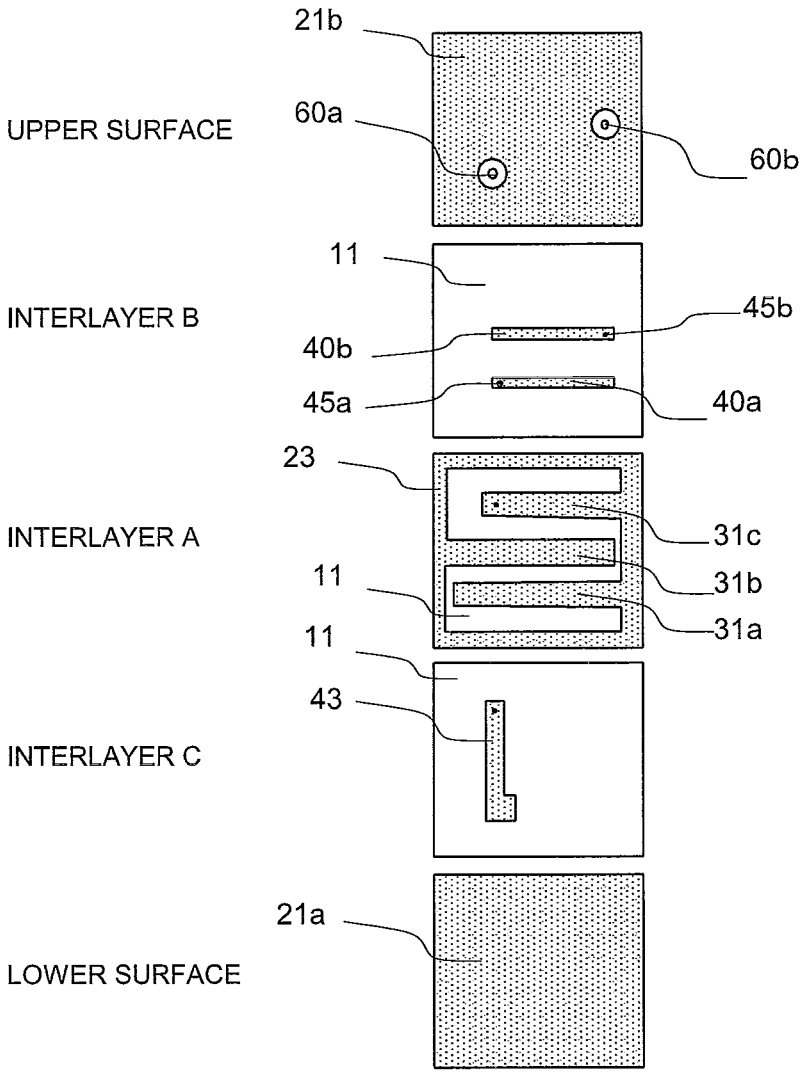
FIG. 3 is a plan view schematically illustrating upper and lower surfaces and interlayers of the bandpass filter illustrated in FIG. 1.
Figure 4:
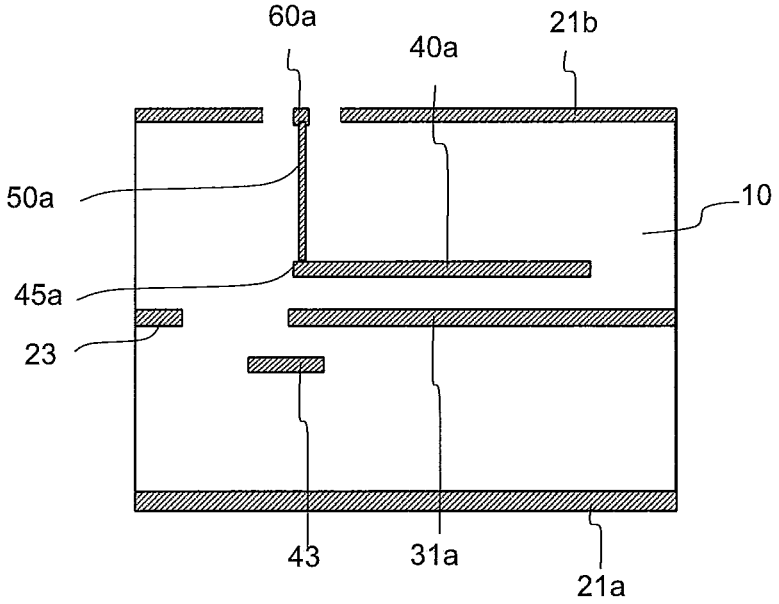
FIG. 4 is a cross-sectional view taken along line Q-Q' of the bandpass filter illustrated in FIG. 1.

FIG. 1 is an external perspective view schematically illustrating a bandpass filter according to a first embodiment of the present invention. FIG. 2 is a schematic exploded perspective view of the bandpass filter illustrated in FIG. 1. FIG. 3 is a plan view schematically illustrating upper and lower surfaces and interlayers of the bandpass filter illustrated in FIG. 1. FIG. 4 is a cross-sectional view taken along line Q-Q' of the bandpass filter illustrated in FIG. 1.

As illustrated in FIG. 1 to FIG. 4, the bandpass filter of the present embodiment includes a laminated body 10, ground electrodes 21*a* and 21*b*, first to third resonance electrodes 31*a*, 31*b*, and 31*c*, a first input/output coupling electrode 40*a*, a second input/output coupling electrode 40*b*, and a resonator coupling electrode 43. The laminated body 10 is formed by stacking a plurality of dielectric layers 11. The ground electrode 21*a* is disposed over the entire lower surface of the laminated body 10. The ground electrode 21*b* is disposed over substantially the entire upper surface of the laminated body 10. The first to third resonance electrodes 31*a*, 31*b*, and 31*c* are sequentially arranged side-by-side, as viewed in the stacking direction, on an interlayer A of the laminated body 10 such that they are electromagnetically coupled to each other. The first to third resonance electrodes 31*a*, 31*b*, and 31*c* are grounded at one end and form first to third resonators, respectively. The first input/output coupling electrode 40*a* is a strip-shaped electrode disposed in an interlayer B above the interlayer A of the laminated body 10 such that it faces the first resonance electrode 31*a* and is electromagnetically coupled thereto. The second input/output coupling electrode 40*b* is a strip-shaped electrode disposed in the interlayer B of the laminated body 10 such that it faces the second resonance electrode 31*b* and is electromagnetically coupled thereto. The resonator coupling electrode 43 is disposed in an interlayer C below the interlayer A of the laminated body and provides electromagnetic coupling between the first resonance electrode 31*a* and the third resonance electrode 31*c*. A first input/output terminal electrode 60*a* on the upper surface of the laminated body 10 is spaced from the ground electrode 21*b* and connected through a feedthrough conductor 50*a* to the first input/output coupling electrode 40*a*. A second input/output terminal electrode 60*b* on the upper surface of the laminated body 10 is spaced from the ground electrode 21*b* and connected through a feedthrough conductor 50*b* to the second input/output coupling electrode 40*b*. An annular ground electrode 23 on the interlayer A of the laminated body 10 is positioned around the first to third resonance electrodes 31*a*, 31*b*, and 31*c*. The first to third resonance electrodes 31*a*, 31*b*, and 31*c* are connected at one end to the annular ground electrode 23 in an inter-digital manner.

In the bandpass filter of the present embodiment, the resonator coupling electrode 43 is connected at one end through a feedthrough conductor 50*c* to the other end of the third resonance electrode 31*c*. The resonator coupling electrode 43 and the third resonance electrode 31*c* thus form the third resonator. The other end of the resonator coupling electrode 43 faces the other end of the first resonance electrode 31*a*, with the dielectric layer 11 interposed therebetween, and is electromagnetically coupled mainly capacitively to the first resonance electrode 31*a*. The resonance frequencies of the first and second resonators are set such that they are equal and higher than the resonance frequency of the third resonator.

In the bandpass filter of the present embodiment, a first input/output point 45*a* at which an electric signal is input to and output from the first input/output coupling electrode 40*a* is located to one side of the center of a part of the first input/output coupling electrode 40*a* facing the first resonance electrode 31*a*, the one side being close to the other end of the first resonance electrode 31*a*. Similarly, a second input/output point 45*b* at which an electric signal is input to and output from the second input/output coupling electrode 40*b* is located to one side of the center of a part of the second input/output coupling electrode 40*b* facing the second resonance electrode 31*b*, the one side being close to the other end of the second resonance electrode 31*b*.

In the bandpass filter of the present embodiment having the configuration described above, for example, when an electric signal from an external circuit is input through the first input/output terminal electrode 60*a* and the feedthrough conductor 50*a* to the first input/output point 45*a* of the first input/output coupling electrode 40*a*, the first resonance electrode 31*a* electromagnetically coupled to the first input/output coupling electrode 40*a* is excited and, at the same time, the second resonance electrode 31*b* electromagnetically coupled to the first resonance electrode 31*a* resonates. When the first resonance electrode 31*a* resonates, the third resonance electrode 31*c* electromagnetically coupled through the resonator coupling electrode 43 to the first resonance electrode 31*a* also resonates. The resulting energy is transmitted to the second resonance electrode 31*b* electromagnetically coupled to the third resonance electrode 31*c*. Through these two routes, electric signals are transmitted to the second resonance electrode 31*b*. Then, the electric signals are output from the second input/output point 45*b* of the second input/output coupling electrode 40*b* electromagnetically coupled to the second resonance electrode 31*b*, through the feedthrough conductor 50*b* and the second input/output terminal electrode 60*b*, to an external circuit.

In the bandpass filter of the present embodiment, two resonance peaks of an even mode and an odd mode are formed by electromagnetic coupling between the first and second resonators that are adjacent and have the same resonance frequency. Additionally, the third resonance peak is formed by direct electromagnetic coupling of the third resonator having a resonance frequency lower than that of the first and second resonators to the second resonator and, at the same time, by electromagnetic coupling of the third resonator through the resonator coupling electrode 43 to the first resonator. Thus, since these three resonance peaks can be used to produce a passband, a bandpass filter for a wide frequency band can be realized. Moreover, since frequencies of the three resonance peaks can be set to any values, a bandpass filter having a large degree of freedom in designing a passband can be realized.

In the bandpass filter of the present embodiment, the first to third resonance electrodes 31*a*, 31*b*, and 31*c* are inter-digitally arranged at their grounded ends, and are electromagnetically coupled to each other. Therefore, the electromagnetic coupling between the first resonance electrode 31*a* and the second resonance electrode 31*b* and the electromagnetic coupling between the second resonance electrode 31*b* and the third resonance electrode 31*c* both are mainly capacitive. At the same time, the first resonance electrode 31*a* and the third resonance electrode 31*c* are electromagnetically coupled mainly capacitively to each other, through the resonator coupling electrode 43. Thus, the first to third resonators are all electromagnetically coupled mainly capacitively to each other. Additionally, the resonance frequency of the first and second resonators is set to be higher than that of the third resonator. Therefore, between an electric signal directly transmitted from the first resonator to the second resonator and a signal transmitted from the first resonator through the third resonator to the second resonator, a phase inversion does not occur in the frequency range of the three resonance peaks but occurs at frequencies lower than the frequency range of the three resonance peaks. Thus, a bandpass filter having good transmission characteristics can be realized in which there is no attenuation pole within a passband including frequencies of the three resonance peaks and there is one or more attenuation poles outside the passband, that is, at frequencies lower than those of the three resonance peaks.

A mechanism for realizing the above-described effects will be described in more detail. In the bandpass filter of the present embodiment, there are an electric signal directly transmitted from the first resonance electrode 31*a* constituting the first resonator to the second resonance electrode 31*b* constituting the second resonator, and a signal transmitted from the first resonance electrode 31*a* through the third resonance electrode 31*c* constituting the third resonator to the second resonance electrode 31*b*. In a frequency range outside the frequencies of two resonance peaks of even mode resonance and odd mode resonance in a resonance system composed of the first resonator and the second resonator, the transmission route through which the electric signal is directly transmitted from the first resonance electrode 31*a* to the second resonance electrode 31*b* is equivalent to an inductor if the first resonance electrode 31*a* and the second resonance electrode 31*b* are mainly inductively coupled, but is equivalent to a capacitor if the first resonance electrode 31*a* and the second resonance electrode 31*b* are mainly capacitively coupled.

If the electromagnetic coupling between the first resonance electrode 31*a* and the third resonance electrode 31*c* and the electromagnetic coupling between the third resonance electrode 31*c* and the second resonance electrode 31*b* are both mainly inductive or both mainly capacitive, the transmission route through which the electric signal is transmitted from the first resonance electrode 31*a* through the third resonance electrode 31*c* to the second resonance electrode 31*b* is equivalent to an inductor at frequencies lower than the resonance frequency of the second resonator, but is equivalent to a capacitor at frequencies higher than the resonance frequency of the second resonator. If one of the electromagnetic coupling between the first resonance electrode 31*a* and the third resonance electrode 31*c* and the electromagnetic coupling between the third resonance electrode 31*c* and the second resonance electrode 31*b* is mainly inductive and the other is mainly capacitive, the transmission route through which the electric signal is transmitted from the first resonance electrode 31*a* through the third resonance electrode 31*c* to the second resonance electrode 31*b* is equivalent to a capacitor at frequencies lower than the resonance frequency of the second resonator, but is equivalent to an inductor at frequencies higher than the resonance frequency of the second resonator.

As described above, the first to third resonators are electromagnetically coupled mainly capacitively to each other, and the resonance frequency of the first and second resonators is set to be higher than that of the third resonator. Therefore, between an electric signal directly transmitted from the first resonator to the second resonator and a signal transmitted from the first resonator through the third resonator to the second resonator, a phase inversion does not occur in the frequency range of the three resonance peaks but occurs at frequencies lower than the frequency range of the three resonance peaks. Thus, a bandpass filter having good transmission characteristics can be realized in which there is no attenuation pole within a passband including frequencies of the three resonance peaks and there is one or more attenuation poles outside the passband, that is, at frequencies lower than those of the three resonance peaks.

In the bandpass filter of the present embodiment, the dielectric layers 11 can be made of resin, such as epoxy resin, or of ceramic, such as dielectric ceramic. For example, a glass-ceramic material is preferably used which is composed of a dielectric ceramic material, such as $BaTiO_3$, $Pb_4Fe_2Nb_2O_{12}$, or $TiO_2$, and a glass material, such as $B_2O_3$, $SiO_2$, $Al_2O_3$, or ZnO, and can be fired at relatively low temperatures ranging from about 800° C. to 1200° C. The thickness of each dielectric layer 11 is set to, for example, about 0.01 mm to 0.1 mm.

As a material of the various electrodes and feedthrough conductors described above, a conductive material mainly composed of Ag or Ag alloy, such as Ag—Pd or Ag—Pt, or a Cu-based, W-based, Mo-based, or Pd-based conductive material is preferably used. The thickness of each of the various electrodes is set to, for example, 0.001 mm to 0.2 mm.

The bandpass filter of the present embodiment can be made, for example, by the following process. First, slurry is made by adding appropriate organic solvents and others to ceramic raw powder and mixing them, so that ceramic green sheets are produced by a doctor blade method. Next, through holes for forming feedthrough conductors are created in the resulting ceramic green sheets by a punching machine or the like. The through holes are filled with a conductive paste containing a conductor of Ag, Ag—Pd, Au, or Cu. At the same time, a conductive paste of the same type is applied to surfaces of the ceramic green sheets using a print method. Thus, the ceramic green sheets with conductive paste are made. Next, the ceramic green sheets with conductive paste are stacked, press-bonded by a hot pressing machine, and fired at a peak temperature of about 800° C. to 1050° C.

Second Embodiment

Figure 5:
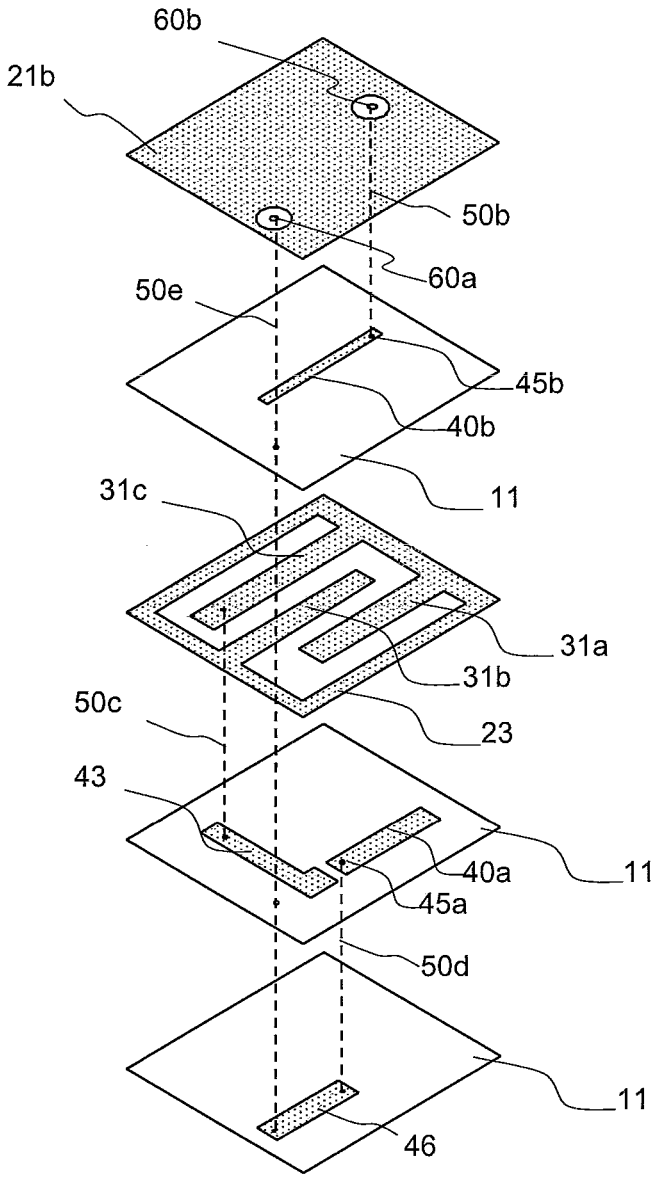
FIG. 5 is an exploded perspective view schematically illustrating a bandpass filter according to a second embodiment of the present invention.
Figure 6:
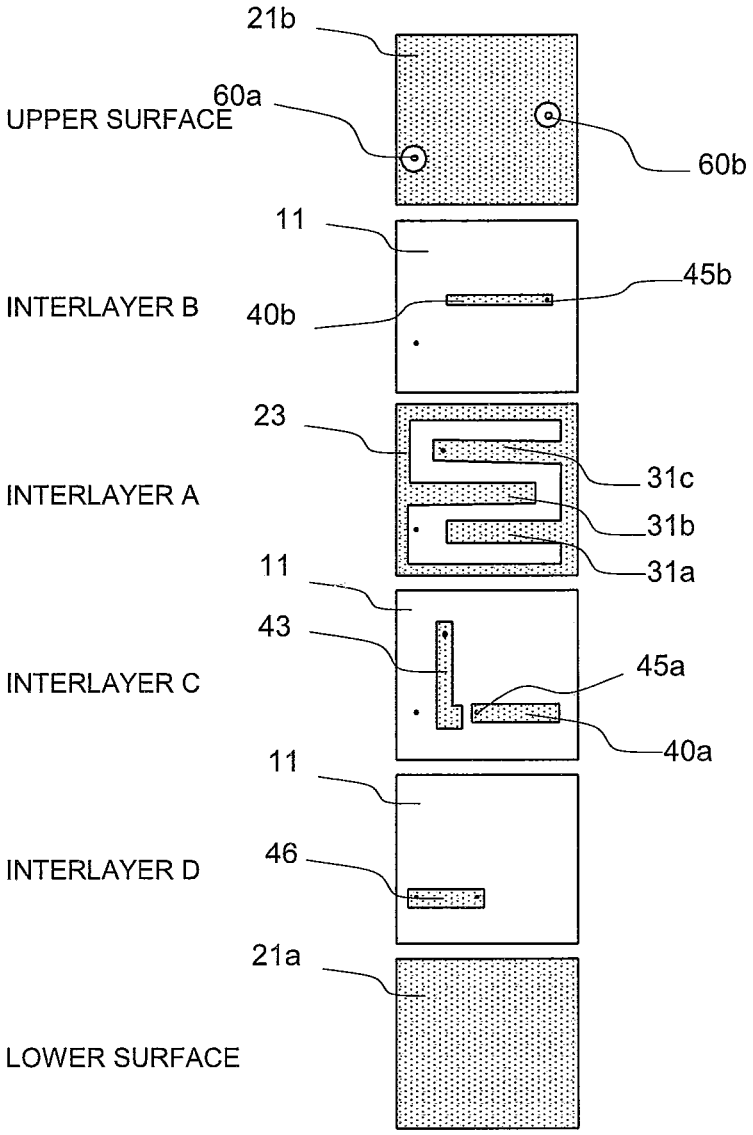
FIG. 6 is a plan view schematically illustrating upper and lower surfaces and interlayers of the bandpass filter illustrated in FIG. 5.

FIG. 5 is an exploded perspective view schematically illustrating a bandpass filter according to a second embodiment of the present invention. FIG. 6 is a plan view schematically illustrating upper and lower surfaces and interlayers of the bandpass filter illustrated in FIG. 5. In the present embodiment, a description will be given only of differences from the first embodiment described above. The same components are denoted by the same reference numerals, and a redundant description will be omitted.

In the bandpass filter of the present embodiment, as illustrated in FIG. 5 and FIG. 6, the first input/output coupling electrode 40*a* and the resonator coupling electrode 43 are disposed in the interlayer C of the laminated body. The first input/output coupling electrode 40*a* is connected through a feedthrough conductor 50*d* to a first connection electrode 46 disposed in an interlayer D below the interlayer C. The first connection electrode 46 is connected through a feedthrough conductor 50*e* to the first input/output terminal electrode 60*a*.

In the bandpass filter of the present embodiment having the configuration described above, the first input/output coupling electrode 40*a* and the second input/output coupling electrode 40*b* are disposed separately on the interlayer C and the interlayer B, respectively, on opposite sides of the interlayer A. It is thus possible to prevent the electromagnetic coupling between the first input/output coupling electrode 40*a* and the second input/output coupling electrode 40*b* from becoming too strong.

Third Embodiment

Figure 7:
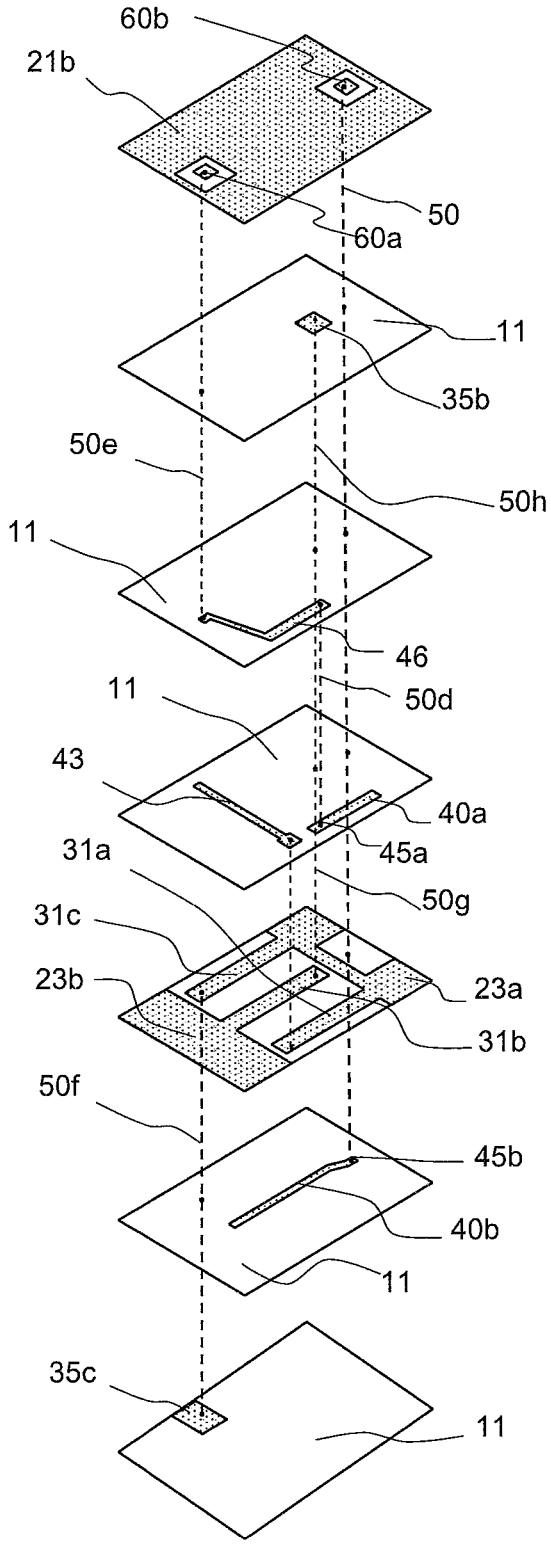
FIG. 7 is an exploded perspective view schematically illustrating a bandpass filter according to a third embodiment of the present invention.
Figure 8:
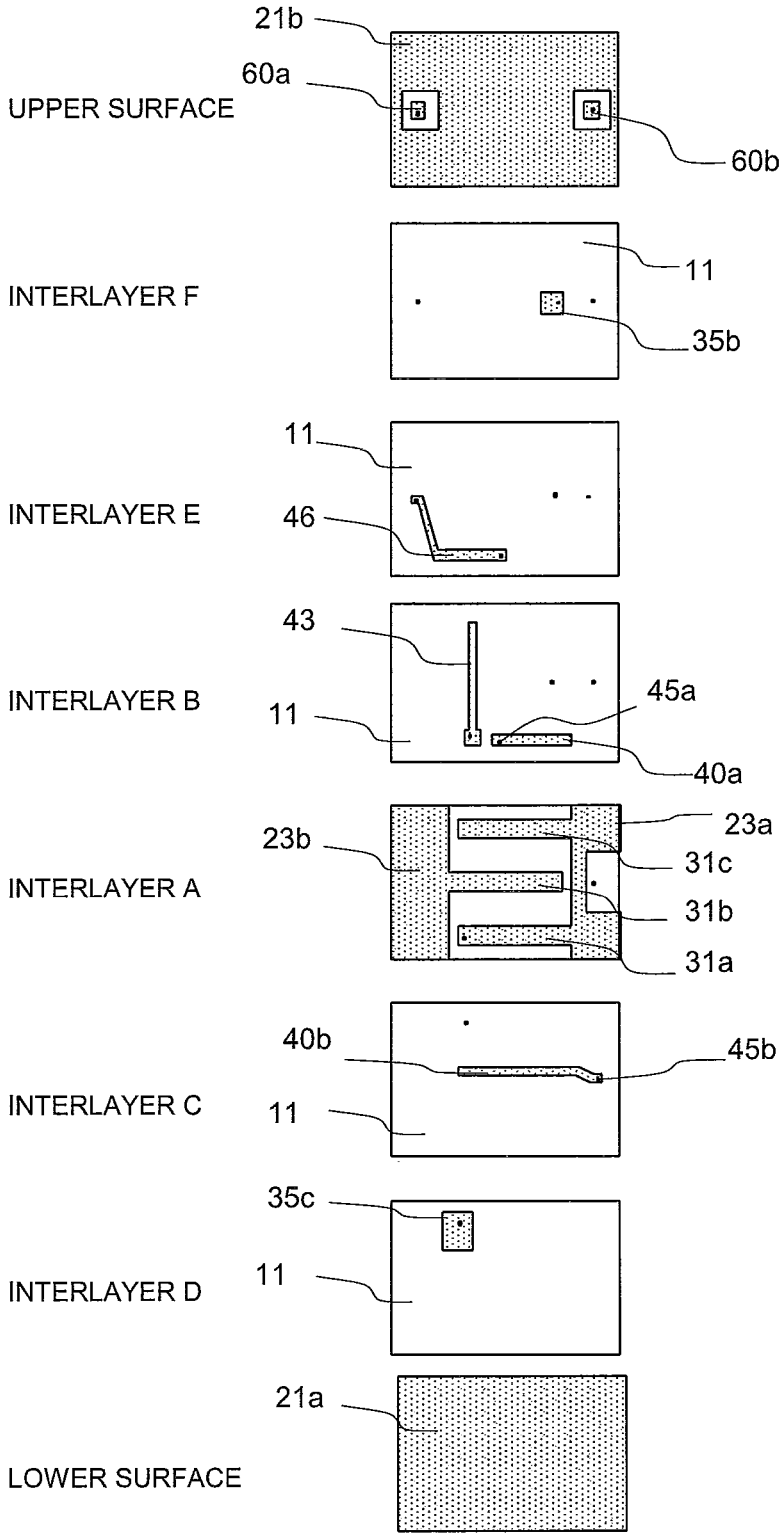
FIG. 8 is a plan view schematically illustrating upper and lower surfaces and interlayers of the bandpass filter illustrated in FIG. 7.

FIG. 7 is an exploded perspective view schematically illustrating a bandpass filter according to a third embodiment of the present invention. FIG. 8 is a plan view schematically illustrating upper and lower surfaces and interlayers of the bandpass filter illustrated in FIG. 7. In the present embodiment, a description will be given only of differences from the second embodiment described above. The same components are denoted by the same reference numerals, and a redundant description will be omitted.

In the bandpass filter of the present embodiment, as illustrated in FIG. 7 and FIG. 8, an inner-layer ground electrode 23*a* and an inner-layer ground electrode 23*b*, instead of the annular ground electrode 23, are disposed in the first interlayer. The first resonance electrode 31*a* and the third resonance electrode 31*c* are connected at one end to the inner-layer ground electrode 23*a*, and the second resonance electrode 31*b* is connected at one end to the inner-layer ground electrode 23*b*. The first input/output coupling electrode 40*a* is disposed in the interlayer B, and the second input/output coupling electrode 40*b* is disposed in the interlayer C. A third capacitance electrode 35*c* on the interlayer D faces the ground electrode 21*a* with the dielectric layer 11 interposed therebetween. At the same time, the third capacitance electrode 35*c* is connected through a feedthrough conductor 50*f* to the other end of the third resonance electrode 31*c*. The first input/output coupling electrode 40*a* and the resonator coupling electrode 43 are disposed in the interlayer B. One end of the resonator coupling electrode 43 is connected through a feedthrough conductor 50*g* to the other end of the first resonance electrode 31*a*. The other end of the resonator coupling electrode 43 faces the other end of the third resonance electrode 31*c*, with the dielectric layer 11 interposed therebetween, and is electromagnetically coupled thereto. The first connection electrode 46 is disposed in an interlayer E above the interlayer B. A second capacitance electrode 35*b* disposed in an interlayer F above the interlayer E faces the ground electrode 21*b*, with the dielectric layer 11 interposed therebetween. At the same time, the second capacitance electrode 35*b* is connected through a feedthrough conductor 50*h* to the other end of the second resonance electrode 31*b*.

In the bandpass filter of the present embodiment, the first resonator is formed by the first resonance electrode 31*a*, the resonator coupling electrode 43, and the feedthrough conductor 50*g* connecting them. The second resonator is formed by the second resonance electrode 31*b*, the second capacitance electrode 35*b*, and the feedthrough conductor 50*h* connecting them. The third resonator is formed by the third resonance electrode 31*c*, the third capacitance electrode 35*c*, and the feedthrough conductor 50*f* connecting them.

In the bandpass filter of the present embodiment having the configuration described above, the length of the second resonance electrode 31*b* can be reduced by capacitance between the second capacitance electrode 35*b* and the ground electrode 21*b*. The length of the third resonance electrode 31*c* can be reduced by capacitance between the third capacitance electrode 35*c* and the ground electrode 21*a*. The length of the first resonance electrode 31*a* can be reduced by the resonator coupling electrode 43. A compact bandpass filter can thus be realized.

Fourth Embodiment

Figure 9:
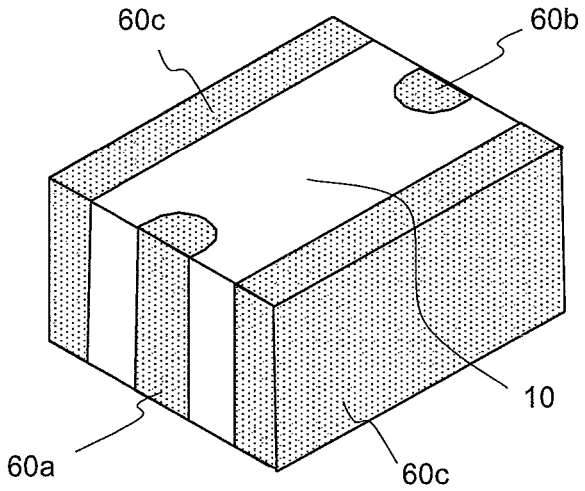
FIG. 9 is an external perspective view schematically illustrating a bandpass filter according to a fourth embodiment of the present invention.
Figure 10:
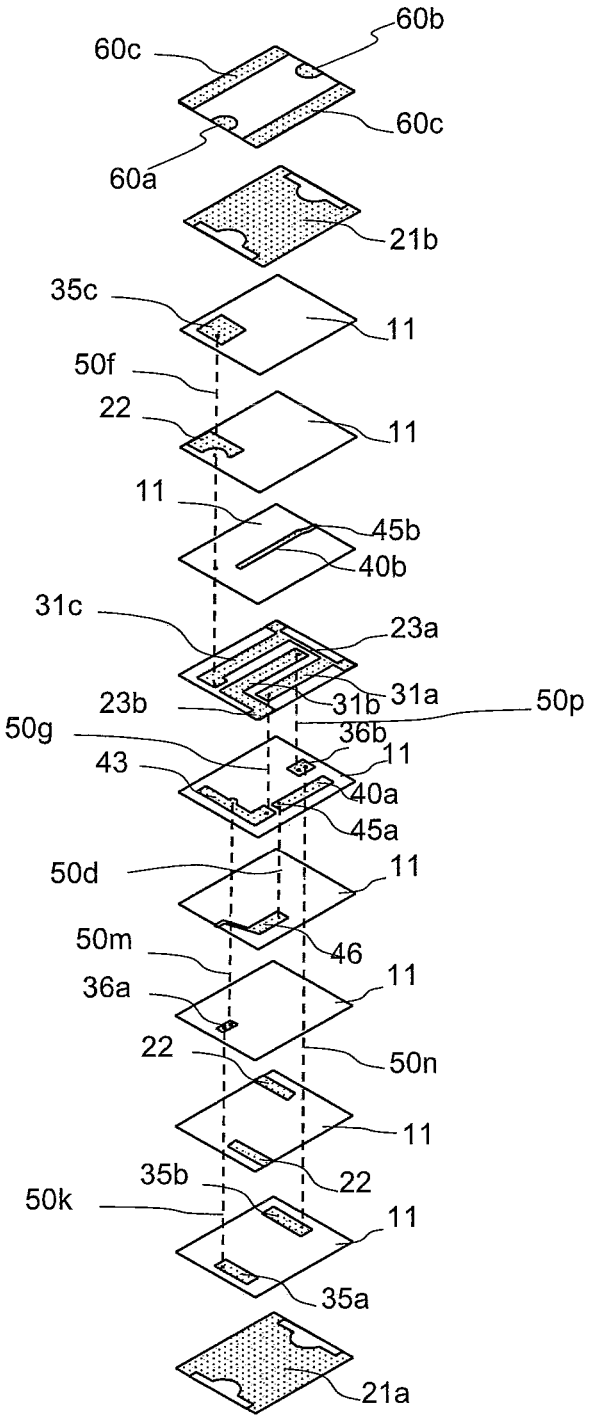
FIG. 10 is a schematic exploded perspective view of the bandpass filter illustrated in FIG. 9.
Figure 11:
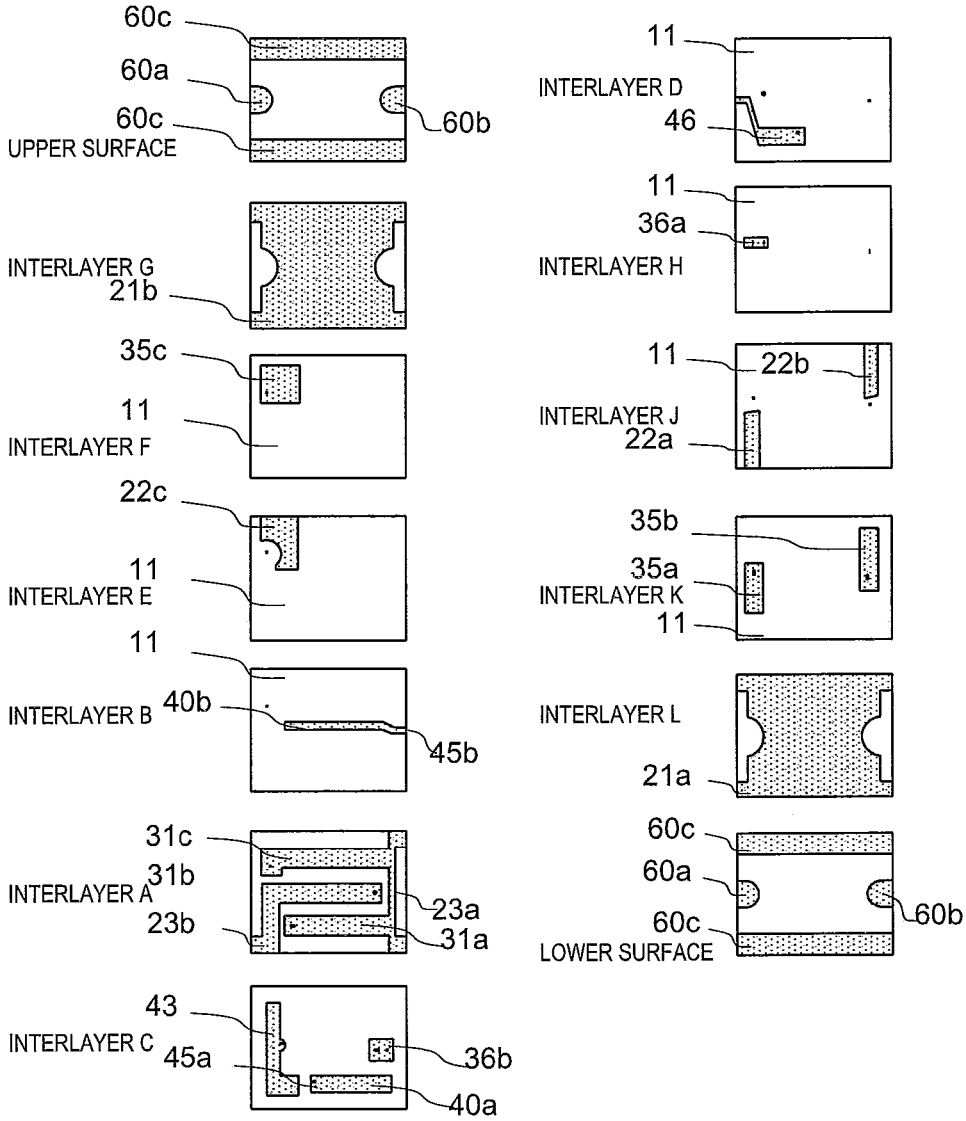
FIG. 11 is a plan view schematically illustrating upper and lower surfaces and interlayers of the bandpass filter illustrated in FIG. 9.

FIG. 9 is an external perspective view schematically illustrating a bandpass filter according to a fourth embodiment of the present invention. FIG. 10 is a schematic exploded perspective view of the bandpass filter illustrated in FIG. 9. FIG. 11 is a plan view schematically illustrating upper and lower surfaces and interlayers of the bandpass filter illustrated in FIG. 9. In the present embodiment, a description will be given only of differences from the third embodiment described above. The same components are denoted by the same reference numerals, and a redundant description will be omitted.

In the bandpass filter of the present embodiment, as illustrated in FIG. 9 to FIG. 11, an additional dielectric layer 11 is disposed above the ground electrode 21*b* on the upper surface of the laminated body, and another additional dielectric layer 11 is disposed below the ground electrode 21*a* on the lower surface of the laminated body. A new laminated body 10 is thus produced. The first input/output terminal electrode 60*a* and the second input/output terminal electrode 60*b* are disposed separately on two opposite sides of the laminated body 10. Ground terminal electrodes 60*c* connected to the inner-layer ground electrodes 23*a* and 23*b* and the ground electrodes 21 are disposed on the other two opposite sides of the laminated body 10.

In the bandpass filter of the present embodiment, the second input/output coupling electrode 40*b* is disposed in the interlayer B, and connected at one end to the second input/output terminal electrode 60*b* on the side of the laminated body 10. This means that the second input/output point 45*b* is a node between the second input/output coupling electrode 40*b* and the second input/output terminal electrode 60*b*. The first input/output coupling electrode 40*a*, the resonator coupling electrode 43, and a third connection electrode 36*b* are disposed in the interlayer C. The first connection electrode 46 is disposed in the interlayer D. The first connection electrode 46 is connected at one end through the feedthrough conductor 50*d* to the first input/output point 45*a* of the first input/output coupling electrode 40*a*, and directly connected at the other end to the first input/output terminal electrode 60*a* on the side of the laminated body 10. An inner-layer ground electrode 22*c* connected to one of the ground terminal electrodes 60*c* is disposed in the interlayer E to face the third capacitance electrode 35*c* on the interlayer F. The third capacitance electrode 35*c* faces the ground electrode 21*b* on an interlayer G above the interlayer F, with the dielectric layer 11 interposed therebetween. At the same time, the third capacitance electrode 35*c* is connected through the feedthrough conductor 50*f* to the other end of the third resonance electrode 31*c*. A second connection electrode 36*a* is disposed in an interlayer H below the interlayer D. An inner-layer ground electrode 22*a* and an inner-layer ground electrode 22*b* are disposed in an interlayer J below the interlayer H. The inner-layer ground electrode 22*a* is disposed to face a first capacitance electrode 35*a* on an interlayer K below the interlayer J. The inner-layer ground electrode 22*b* is disposed to face the second capacitance electrode 35*b* on the interlayer K. The two inner-layer ground electrodes 22*a* and 22*b* on the interlayer J are connected to the respective ground terminal electrodes 60*c*. The first capacitance electrode 35*a* faces the ground electrode 21*a* on an interlayer L below the interlayer K, with the dielectric layer 11 interposed therebetween. At the same time, the first capacitance electrode 35*a* is connected through a feedthrough conductor 50*k* to the second connection electrode 36*a*. The second connection electrode 36*a* is connected through a feedthrough conductor 50*m* to the resonator coupling electrode 43. The resonator coupling electrode 43 faces the other and of the third resonance electrode 31*c*, with the dielectric layer 11 interposed therebetween. At the same time, the resonator coupling electrode 43 is connected through the feedthrough conductor 50*g* to the other end of the first resonance electrode 31*a*. The second capacitance electrode 35*b* faces the ground electrode 21 on the interlayer L with the dielectric layer 11 interposed therebetween, and is connected through a feedthrough conductor 50*n* to the third connection electrode 36*b*. The third connection electrode 36*b* is connected through a feedthrough conductor 50*p* to the other end of the second resonance electrode 31*b*.

In the bandpass filter of the present embodiment, the first resonator is formed by the first resonance electrode 31*a*, the resonator coupling electrode 43, the second connection electrode 36*a*, the first capacitance electrode 35*a*, and the feedthrough conductors 50*g*, 50*m*, and 50*k* connecting them. The second resonator is formed by the second resonance electrode 31*b*, the third connection electrode 36*b*, the second capacitance electrode 35*b*, and the feedthrough conductors 50*p* and 50*n* connecting them. The third resonator is formed by the third resonance electrode 31*c*, the third capacitance electrode 35*c*, and the feedthrough conductor 50*f* connecting them.

In the bandpass filter of the present embodiment having the configuration described above, the capacitances between the first to third capacitance electrodes 35*a*, 35*b*, and 35*c* and the ground electrodes 21*a* and 21*b* and inner-layer ground electrodes 22*a*, 22*b*, and 22*c* facing the first to third capacitance electrodes 35*a*, 35*b*, and 35*c* are added to the respective first to third resonators. This can further reduce the lengths of the first to third resonance electrodes 31*a*, 31*b*, and 31*c*. A more compact bandpass filter can thus be realized.

Figure 12:
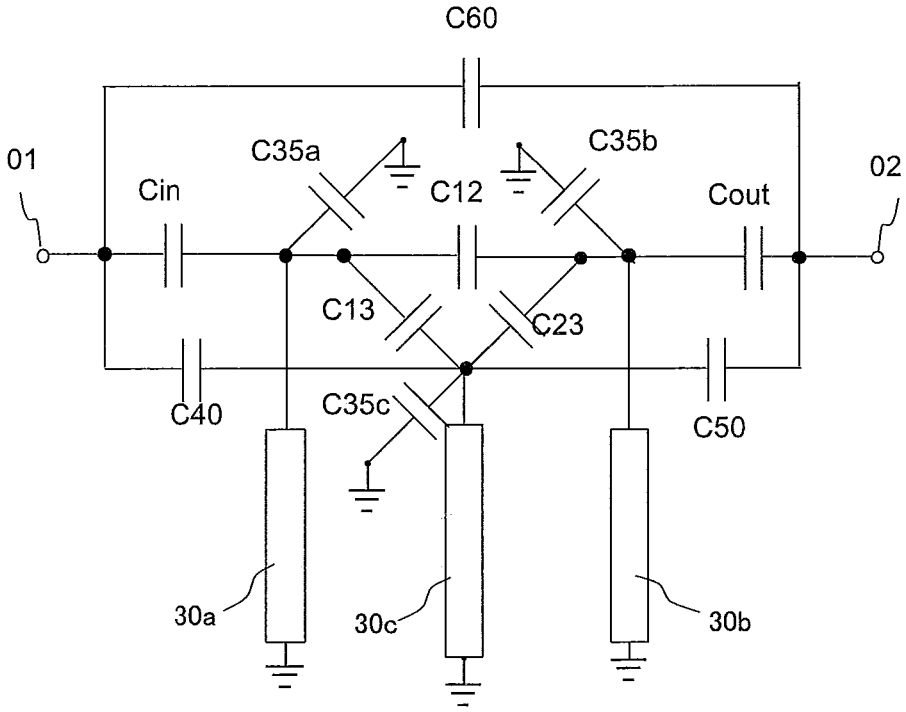
FIG. 12 is an equivalent circuit diagram of the bandpass filters according to the third and fourth embodiments of the present invention.

An equivalent circuit of the bandpass filters according to the third and fourth embodiments is illustrated in FIG. 12. Reference numerals 01 and 02 denote input/output terminals. Reference numerals 30*a*, 30*b*, and 30*c* denote the first resonator, the second resonator, and the third resonator, respectively. The three resonators are all capacitively coupled to each other by capacitors C12, C13, and C23 formed by direct electromagnetic coupling between the first to third resonance electrodes 31*a*, 31*b*, and 31*c* or by electromagnetic coupling between the first to third resonance electrodes 31*a*, 31*b*, and 31*c* through the resonator coupling electrode 43. A capacitor C60 is formed by electromagnetic coupling between the first input/output coupling electrode 40*a* and the second input/output coupling electrode 40*b*. Capacitors C40 and C50 are formed by electromagnetic coupling between the first input/output coupling electrode 40*a* and the second input/output coupling electrode 40*b*, and the third resonance electrode 31*c*. With this configuration, in transmission characteristics of the bandpass filter, three attenuation poles can be formed at frequencies lower than the passband. Reference numerals C35, C36, and C37 denote capacitances formed between the ground potential and the first resonance electrode 31*a*, the second resonance electrode 31*b*, and the third resonance electrode 31*c* by the first capacitance electrode 35*a*, the second capacitance electrode 35*b*, and the third capacitance electrode 35*c*, respectively.

Fifth Embodiment

Figure 13:
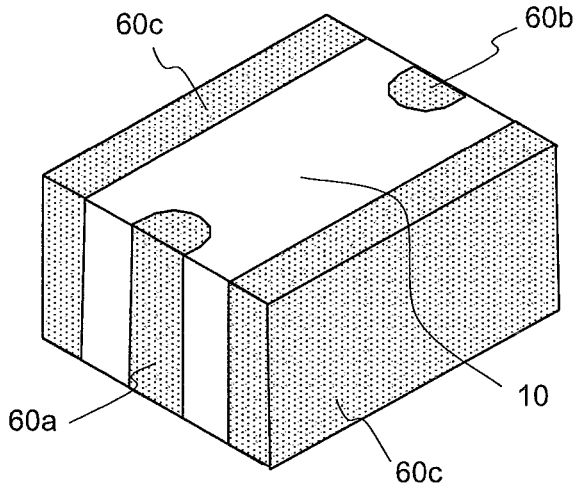
FIG. 13 is an external perspective view schematically illustrating a bandpass filter according to a fifth embodiment of the present invention.
Figure 14:
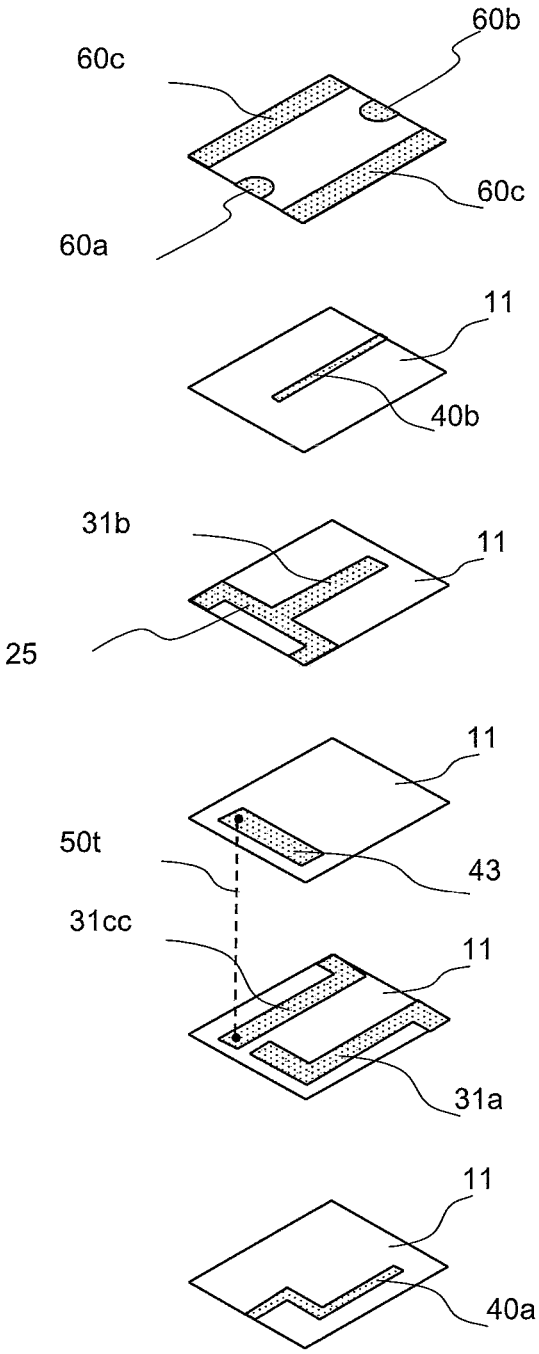
FIG. 14 is a schematic exploded perspective view of the bandpass filter illustrated in FIG. 13.
Figure 15:
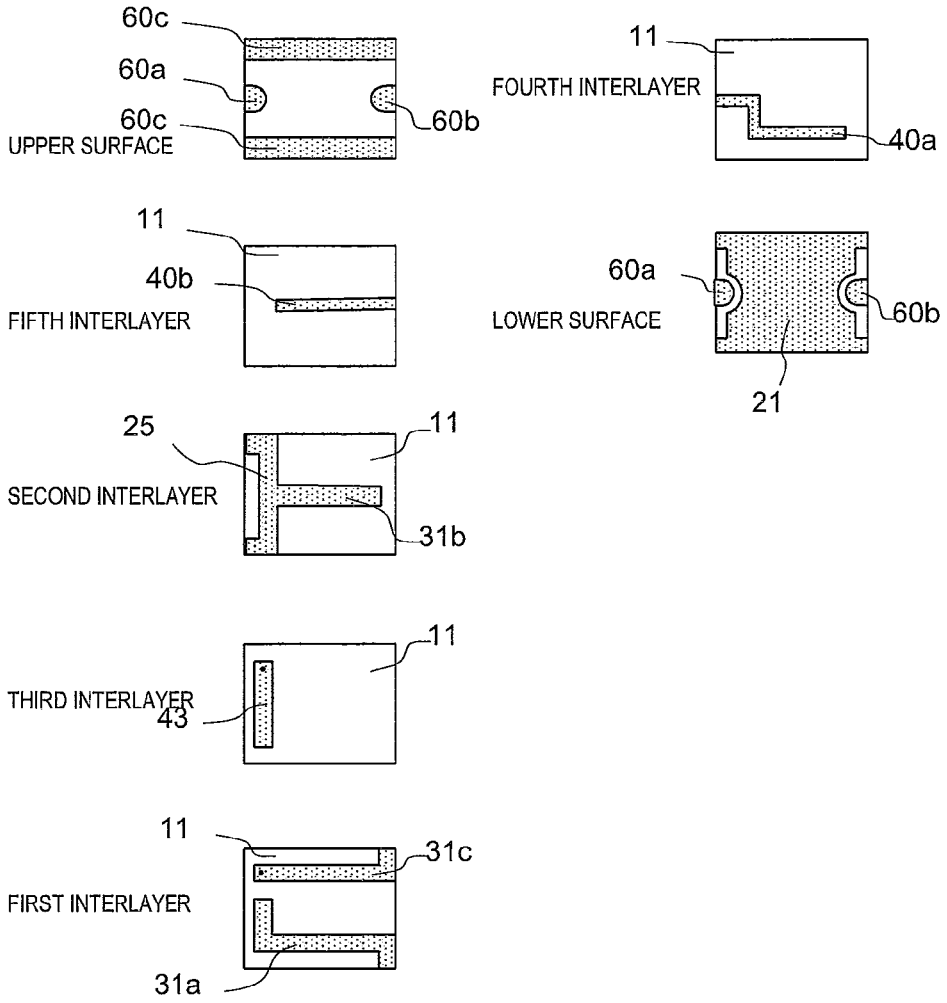
FIG. 15 is a plan view schematically illustrating upper and lower surfaces and interlayers of the bandpass filter illustrated in FIG. 13.

FIG. 13 is an external perspective view schematically illustrating a bandpass filter according to a fifth embodiment of the present invention. FIG. 14 is a schematic exploded perspective view of the bandpass filter illustrated in FIG. 13. FIG. 15 is a plan view schematically illustrating upper and lower surfaces and interlayers of the bandpass filter illustrated in FIG. 13.

As illustrated in FIG. 13 to FIG. 15, the bandpass filter of the present embodiment includes the laminated body 10, the first input/output terminal electrode 60*a*, the second input/output terminal electrode 60*b*, the ground terminal electrodes 60*c*, the ground electrode 21*a*, an internal ground electrode 25, the first to third resonance electrodes 31*a*, 31*b*, and 31*c*, the resonator coupling electrode 43, the strip-shaped first input/output coupling electrode 40*a*, and the strip-shaped second input/output coupling electrode 40*b*.

The laminated body 10 is formed by stacking the plurality of dielectric layers 11. The ground terminal electrodes 60*c* are disposed entirely over a pair of opposite sides of the laminated body 10 and connected to the ground potential. The first input/output terminal electrode 60*a* and the second input/output terminal electrode 60*b* on the other pair of opposite sides of the laminated body 10 are spaced from the ground terminal electrodes 60*c*. The first input/output terminal electrode 60*a*, the second input/output terminal electrode 60*b*, and the ground terminal electrodes 60*c* extend, to some extent, to the upper and lower surfaces of the laminated body 10. The ground electrode 21*a* is disposed over substantially the entire lower surface of the laminated body 10 and connected to the ground terminal electrodes 60*c*. The first and third resonance electrodes 31*a* and 31*c* are strip-shaped and are spaced side-by-side on a first interlayer of the laminated body 10. The first and third resonance electrodes 31*a* and 31*c* are connected to the respective ground terminal electrodes 60*c* at one end, and grounded to form first and third resonators, respectively. The second resonance electrode 31*b* is strip-shaped and is disposed in a second interlayer above the first interlayer of the laminated body 10. The second resonance electrode 31*b* is located between the first and third resonance electrodes 31*a* and 31*c*, as viewed in the stacking direction (i.e., as viewed from above), such that the second resonance electrode 31*b* is electromagnetically coupled to the first and third resonance electrodes 31*a* and 31*c*. In other words, the first to third resonance electrodes 31*a*, 31*b*, and 31*c* are sequentially arranged side-by-side, as viewed in the stacking direction, such that they are electromagnetically coupled to each other. The second resonance electrode 31*b* is connected at one end, through the internal ground electrode 25 on the second interlayer of the laminated body 10, to the ground terminal electrodes 60*c* and grounded to form a second resonator. The resonator coupling electrode 43 is strip-shaped and is disposed in a third interlayer between the first and second interlayers of the laminated body 10. One end of the resonator coupling electrode 43 is connected through a feedthrough conductor 50*t* to the other end of the third resonance electrode 31*c*. The other end of the resonator coupling electrode 43 faces the other end of the first resonance electrode 31*a*, with the dielectric layer 11 interposed therebetween, and is electromagnetically coupled thereto. The resonator coupling electrode 43 thus provides electromagnetic coupling between the first and third resonance electrodes 31*a* and 31*c*. The first resonance electrode 31*a* and the third resonance electrode 31*c* are electromagnetically coupled mainly capacitively to each other through the resonator coupling electrode 43. The first input/output coupling electrode 40*a* is strip-shaped. The first input/output coupling electrode 40*a* is disposed in a fourth interlayer below the first interlayer of the laminated body 10 such that the first input/output coupling electrode 40*a* faces the first resonance electrode 31*a*, with the dielectric layer 11 interposed therebetween, and is electromagnetically coupled thereto. The first input/output coupling electrode 40*a* is connected at one end to the first input/output terminal electrode 60*a*. The second input/output coupling electrode 40*b* is strip-shaped. The second input/output coupling electrode 40*b* is disposed in a fifth interlayer above the second interlayer of the laminated body 10 such that the second input/output coupling electrode 40*b* faces the second resonance electrode 31*b*, with the dielectric layer 11 interposed therebetween, and is electromagnetically coupled thereto. The second input/output coupling electrode 40*b* is connected at one end to the second input/output terminal electrode 60*b*.

In the bandpass filter of the present embodiment, the third resonator is formed by the third resonance electrode 31*c*, the resonator coupling electrode 43, and the feedthrough conductor 50*t* connecting them. The second resonator is formed by the second resonance electrode 31*b* and the internal ground electrode 25. The first resonator is formed by the first resonance electrode 31*a*. The first and second resonators have the same resonance frequency higher than that of the third resonator. The first to third resonators are used to produce a passband.

In the bandpass filter of the present embodiment having the configuration described above, three resonance peaks can be used to produce a passband. Therefore, as in the cases of the bandpass filters of the first to fourth embodiments described above, it is possible to realize a bandpass filter that can be used for a wide frequency band and has a large degree of freedom in designing a passband.

In the bandpass filter of the present embodiment, the first to third resonance electrodes 31*a*, 31*b*, and 31*c* are inter-digitally arranged at their grounded ends, and are electromagnetically coupled to each other. The first resonance electrode 31*a* and the third resonance electrode 31*c* are electromagnetically coupled mainly capacitively to each other, through the resonator coupling electrode 43. Thus, the first to third resonators are all mainly capacitively coupled to each other. Additionally, the resonance frequency of the first and second resonators is set to be higher than that of the third resonator. Therefore, between an electric signal directly transmitted from the first resonator to the second resonator and a signal transmitted from the first resonator through the third resonator to the second resonator, a phase inversion does not occur in the frequency range of the three resonance peaks but occurs at frequencies lower than the frequency range of the three resonance peaks. Thus, a bandpass filter having good transmission characteristics can be realized in which there is no attenuation pole within a passband including frequencies of the three resonance peaks and there is one or more attenuation poles at frequencies lower than the passband.

Additionally, in the bandpass filter of the present embodiment, the ground electrode 21*a* is disposed on the lower surface of the laminated body 10. The ground terminal electrodes 60*c* are disposed on two sides of the laminated body 10, the two sides being located at both ends in a direction in which the first to third resonance electrodes 31*a*, 31*b*, and 31*c* are arranged side-by-side as viewed in the stacking direction (i.e., as viewed from above). Also, the ground terminal electrodes 60*c* extend, to some extent, to the upper and lower surfaces of the laminated body 10, the upper and lower surfaces being adjacent to the two sides of the laminated body 10 described above. On the second interlayer above the first interlayer where there are the first and third resonance electrodes 31*a* and 31*c*, the second resonance electrode 31*b* is disposed such that it is located between the first and third resonance electrodes 31*a* and 31*c* as viewed from above. In the bandpass filter of the present embodiment having the configuration described above, it is possible to maximize the distance from the ground electrode 21*a* and the ground terminal electrodes 60*c* to the first to third resonance electrodes 31*a*, 31*b*, and 31*c* within the laminated body 10 of limited size. Thus, since the Q-values of the first to third resonators can be maximized, a compact low-loss bandpass filter can be realized.

Sixth Embodiment

Figure 16:
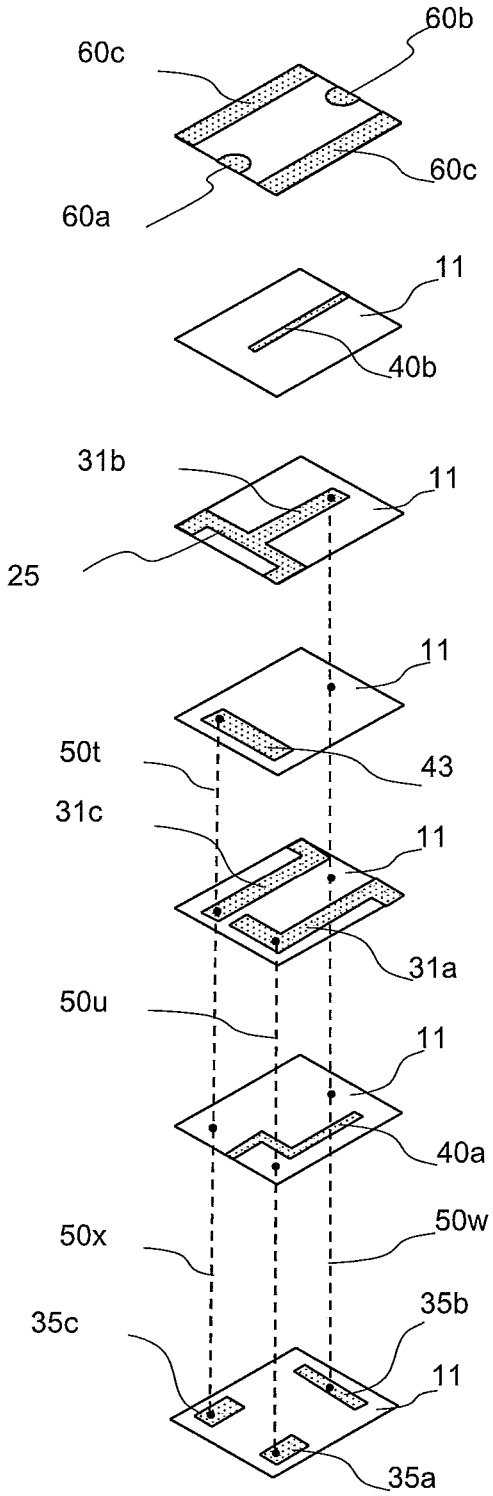
FIG. 16 is an exploded perspective view schematically illustrating a bandpass filter according to a sixth embodiment of the present invention.
Figure 17:
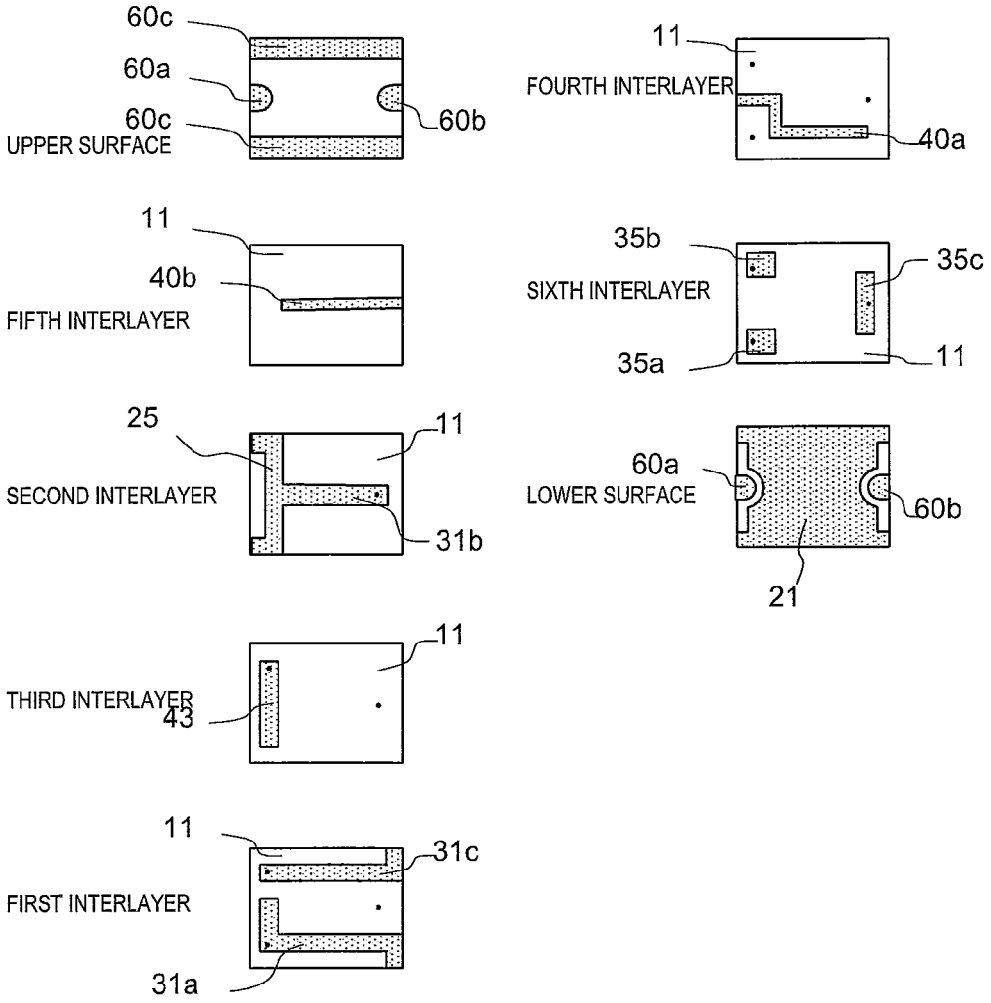
FIG. 17 is a plan view schematically illustrating upper and lower surfaces and interlayers of the bandpass filter illustrated in FIG. 16.

FIG. 16 is an exploded perspective view schematically illustrating a bandpass filter according to a sixth embodiment of the present invention. FIG. 17 is a plan view schematically illustrating upper and lower surfaces and interlayers of the bandpass filter illustrated in FIG. 16. In the present embodiment, a description will be given only of differences from the fifth embodiment described above. The same components are denoted by the same reference numerals, and a redundant description will be omitted.

As illustrated in FIG. 16 and FIG. 17, the bandpass filter of the present embodiment includes the first capacitance electrode 35*a*, the second capacitance electrode 35*b*, and the third capacitance electrode 35*c* that are disposed in a sixth interlayer below the fourth interlayer of the laminated body 10 such that they face the ground electrode 21*a*. The first capacitance electrode 35*a* is connected through a feedthrough conductor 50*u* to the other end of the first resonance electrode 31*a*. The second capacitance electrode 35*b* is connected through a feedthrough conductor 50*w* to the other end of the second resonance electrode 31*b*. The third capacitance electrode 35*c* is connected through a feedthrough conductor 50*x* to the other end of the third resonance electrode 31*c*.

In the bandpass filter of the present embodiment having the configuration described above, since capacitance is formed between the first capacitance electrode 35*a*, the second capacitance electrode 35*b*, and the third capacitance electrode 35*c* and the ground electrode 21*a*, it is possible to reduce the lengths of the first resonance electrode 31*a*, the third resonance electrode 31*c*, and the second resonance electrode 31. A compact bandpass filter can thus be realized. In the bandpass filter of the present embodiment, a first resonator is formed by the first resonance electrode 31*a*, the first capacitance electrode 35*a*, and the feedthrough conductor 50*u* connecting them. A second resonator is formed by the second resonance electrode 31*b*, the third capacitance electrode 35*c*, the feedthrough conductor 50 connecting them, and the internal ground electrode 25. A third resonator is formed by the third resonance electrode 31*c*, the third capacitance electrode 35*c*, the resonator coupling electrode 43, and the feedthrough conductors 50*t* and 50*x* connecting them.

Seventh Embodiment

Figure 18:
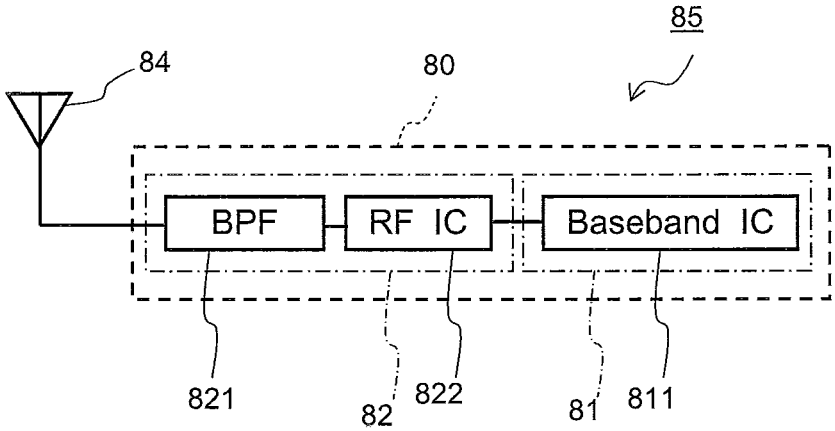
FIG. 18 is a block diagram schematically illustrating a wireless communication module and a wireless communication device according to a seventh embodiment of the present invention.

FIG. 18 is a block diagram illustrating a wireless communication module 80 and a wireless communication device 85 according to a seventh embodiment of the present invention.

The wireless communication module 80 of the present embodiment includes, for example, a baseband unit 81 and an RF unit 82. The baseband unit 81 processes a baseband signal. The RF unit 82 is connected to the baseband unit 81 and processes a modulated baseband signal and an undemodulated RF signal. The RF unit 82 includes a bandpass filter 821 described above. The bandpass filter 821 attenuates an RF signal obtained by modulating a baseband signal, or a received RF signal having a frequency outside a communication band. Specifically, the baseband unit 81 includes a baseband IC 811, and the RF unit 82 includes an RF IC 822 between the bandpass filter 821 and the baseband unit 81. There may be other circuits between the baseband IC 811 and the RF IC 822. The wireless communication device 85 of the present embodiment capable of transmitting and receiving RF signals is made by connecting an antenna 84 to the bandpass filter 821 of the wireless communication module 80.

In the wireless communication module 80 and the wireless communication device 85 of the present embodiment having the configuration described above, the bandpass filter 821 of the present invention that can be used for a wide frequency band and has an attenuation pole outside the passband is used to filter a communication signal. It is thus possible to reduce noise and loss of communication signal throughout the communication band. Therefore, since the reception sensitivity can be improved and the degree of amplification of the communication signal can be reduced, power consumption in an amplifying circuit can be reduced. It is thus possible to realize the high-performance wireless communication module 80 and wireless communication device 85 that have high reception sensitivity and consume less power.

Modifications

The present invention is not limited to the first to seventh embodiments described above, and can be variously changed and modified without departing from the gist of the present invention.

For example, in the first to sixth embodiments described above, the grounded ends of the first to third resonance electrodes 31*a*, 31*b*, and 31*c* are inter-digitally arranged and adjacent resonance electrodes are electromagnetically coupled mainly capacitively to each other, the first resonance electrode 31*a* and the third resonance electrode 31*c* are electromagnetically coupled mainly capacitively to each other through the resonator coupling electrode 43, and the resonance frequency of the first and second resonators is set to be higher than that of the third resonator. However, the present invention is not limited to this. For example, it is allowed that the grounded ends of the first to third resonance electrodes 31*a*, 31*b*, and 31*c* are inter-digitally arranged and adjacent resonance electrodes are electromagnetically coupled mainly capacitively to each other, the first resonance electrode 31*a* and the third resonance electrode 31*c* are electromagnetically coupled mainly inductively to each other through the resonator coupling electrode 43, and the resonance frequency of the first and second resonators are set to be lower than that of the third resonator.

In this case, between an electric signal directly transmitted from the first resonator to the second resonator and a signal transmitted from the first resonator through the third resonator to the second resonator, a phase inversion does not occur in the frequency range of the three resonance peaks but occurs at frequencies higher than the frequency range of the three resonance peaks. Thus, a bandpass filter having good transmission characteristics can be realized in which there is no attenuation pole within a passband including frequencies of the three resonance peaks and there is one or more attenuation poles at frequencies higher than the passband.

To provide mainly inductive electromagnetic coupling between the first resonance electrode 31*a* and the third resonance electrode 31*c* through the resonator coupling electrode 43, for example, the resonator coupling electrode 43 may be grounded at both ends, one end of the resonator coupling electrode 43 may face one end of the first resonance electrode 31*a* and be electromagnetically coupled thereto, and the other end of the resonator coupling electrode 43 may face one end of the third resonance electrode 31*c* and be electromagnetically coupled thereto.

In the first to sixth embodiments described above, the bandpass filter includes the first input/output terminal electrode 60*a* and the second input/output terminal electrode 60*b*. However, if the bandpass filter is in a region within a module substrate, the first input/output terminal electrode 60*a* and the second input/output terminal electrode 60*b* are not necessarily needed. The same applies to the ground terminal electrodes 60*c*.

Also in the first to sixth embodiments described above, the bandpass filter is included in one laminated body 10. Alternatively, the bandpass filter may be provided over a plurality of laminated bodies stacked in the thickness direction.

In the first to fourth embodiments described above, the first to third resonance electrodes 31*a*, 31*b*, and 31*c* are disposed in the same interlayer A of the laminated body 10. In the fifth and sixth embodiments described above, the first and third resonance electrodes 31*a* and 31*c* are disposed in the first interlayer of the laminated body 10, and the second resonance electrode 31*b* is disposed in the second interlayer above the first interlayer. However, the present invention is not limited to the embodiments described above. The first to third resonance electrodes 31*a*, 31*b*, and 31*c* may be disposed in either the same or different interlayers. That is, the first to third resonance electrodes 31*a*, 31*b*, and 31*c* may be disposed in any manner as long as they are sequentially arranged side-by-side, as viewed in the stacking direction, such that they are electromagnetically coupled to each other. For example, the first and second resonance electrodes 31*a* and 31*b* may be disposed in the same interlayer of the laminated body 10, and the third resonance electrode 31*c* may be disposed in a different interlayer. Alternatively, the first to third resonance electrodes 31*a*, 31*b*, and 31*c* may be disposed in different interlayers.

EXAMPLES

Specific examples of the bandpass filter according to the present invention will now be described.

Electrical characteristics of the bandpass filter according to the third embodiment illustrated in FIG. 7 and FIG. 8, the bandpass filter according to the fourth embodiment illustrated in FIG. 9 to FIG. 11, and the bandpass filter according to the sixth embodiment illustrated in FIG. 16 and FIG. 17 were calculated by simulation using a finite element method.

In the simulation of the bandpass filter of the third embodiment, the first to third resonance electrodes 31*a*, 31*b*, and 31*c* were rectangular, 0.25 mm wide, and 1.5 mm long. The second capacitance electrode 35*b* was 0.3 mm square. The third capacitance electrode 35*c* was rectangular, 0.4 mm wide, and 0.5 mm long. The resonator coupling electrode 43 was rectangular, 0.1 mm wide, and 1.4 mm long. The overall shape of the bandpass filter was a rectangular parallelepiped 2.0 mm wide, 3.0 mm long, and 1.0 mm high. The relative dielectric constant of the dielectric layers 11 was 18.7.

In the simulation of the bandpass filter of the fourth embodiment, the first resonance electrode 31*a* was rectangular, 0.35 mm wide, and 1.9 mm long. The second resonance electrode 31*b* was rectangular, 0.35 mm wide, and 2.1 mm long. The third resonance electrode 31*c* was rectangular, 0.35 mm wide, and 2.2 mm long. The first capacitance electrode 35*a* was rectangular, 0.3 mm wide, and 0.88 mm long. The second capacitance electrode 35*b* was rectangular, 0.33 mm wide, and 1.1 mm long. The third capacitance electrode 35*c* was 0.69 mm square. The first input/output coupling electrode 40*a* was rectangular, 0.3 mm wide, and 1.4 mm long. The second input/output coupling electrode 40*b* was rectangular, 0.14 mm wide, and 2.1 mm long. The overall shape of the bandpass filter was a rectangular parallelepiped 2.0 mm wide, 2.5 mm long, and 0.9 mm high. The relative dielectric constant of the dielectric layers 11 was 18.7.

In the simulation of the bandpass filter of the sixth embodiment, the first resonance electrode 31*a* was in the shape of a bent strip 0.31 mm wide and about 2.4 mm long. The third resonance electrode 31*c* was in the shape of a bent strip 0.31 mm wide and about 2 mm long. The second resonance electrode 31*b* was strip-shaped, 0.21 mm wide, and 2 mm long. The resonator coupling electrode 43 was strip-shaped, 0.25 mm wide, and 1.28 mm long. The first input/output coupling electrode 40*a* was in the shape of a bent strip 0.15 mm wide and about 2 mm long. The second input/output coupling electrode 40*b* was strip-shaped, 0.15 mm wide, and 2 mm long. The first, capacitance electrode 35*a* was rectangular, 0.6 mm wide, and 0.8 mm long. The second capacitance electrode 35*b* was rectangular, 0.6 mm wide, and 1.05 mm long. The third capacitance electrode 35*c* was rectangular, 0.35 mm wide, and 1 mm long. The laminated body 10 was in the shape of a rectangular parallelepiped 1.6 mm wide, 2.5 mm long, and 0.9 mm thick. The relative dielectric constant of the dielectric layers 11 was 18.7.

Figure 19:
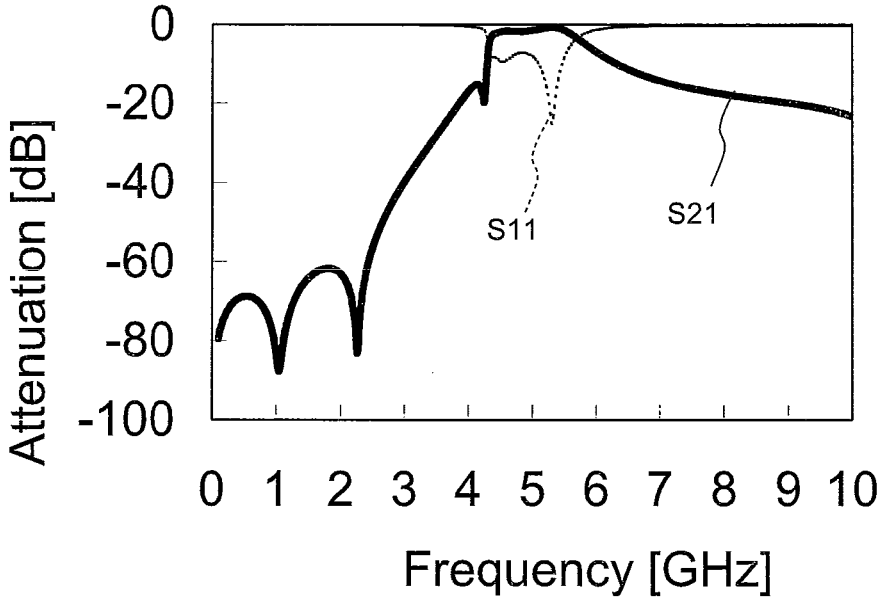
FIG. 19 is a graph showing a result of simulation of electrical characteristics of the bandpass filter according to the third embodiment of the present invention.
Figure 20:
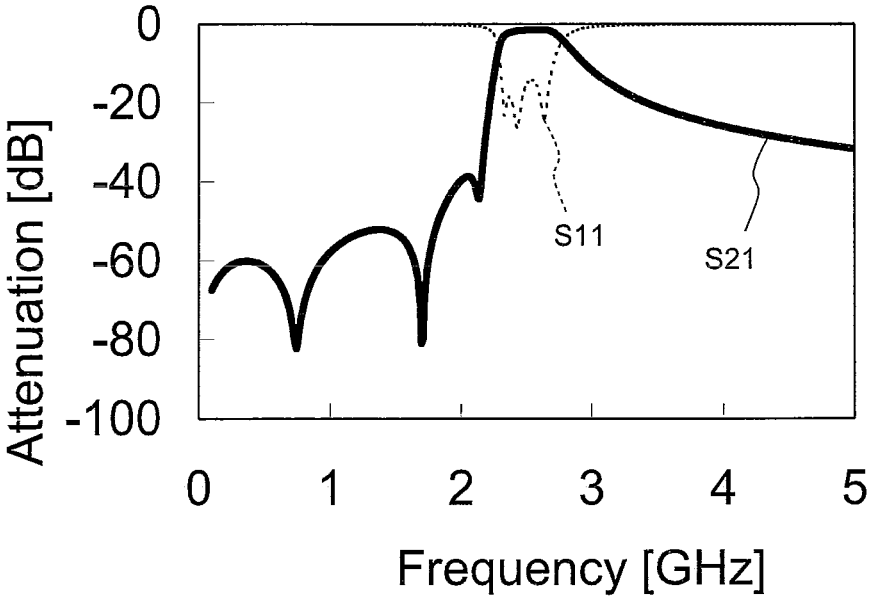
FIG. 20 is graph showing a result of simulation of electrical characteristics of the bandpass filter according to the fourth embodiment of the present invention.
Figure 21:
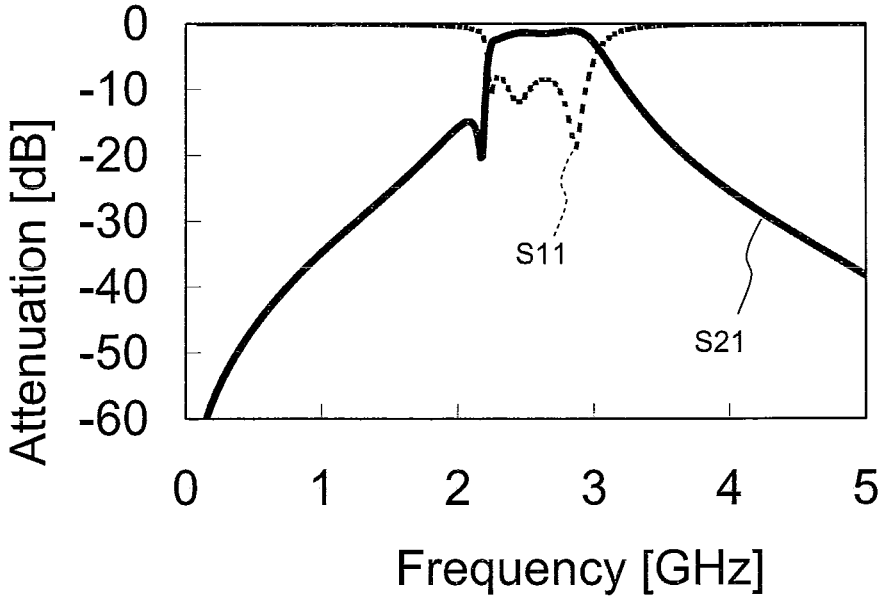
FIG. 21 is graph showing a result of simulation of electrical characteristics of the bandpass filter according to the sixth embodiment of the present invention.

FIG. 19, FIG. 20, and FIG. 21 are graphs showing results of the simulations. In the graphs, the horizontal axis represents frequency and the vertical axis represents attenuation. Specifically, transmission characteristics (S21) and reflection characteristics (S11) of the bandpass filters are shown in the graphs. FIG. 19 is a graph showing characteristics of the bandpass filter according to the third embodiment. FIG. 20 is graph showing characteristics of the bandpass filter according to the fourth embodiment. FIG. 21 is graph showing characteristics of the bandpass filter according to the sixth embodiment.

The graphs of FIG. 19 and FIG. 20 show that both of the bandpass filters have good transmission characteristics in which a wide and flat passband is achieved, three attenuation poles are formed at frequencies lower than the passband, and a sufficient attenuation is obtained at frequencies lower than the passband. The attenuation pole at a frequency closest to the passband is formed by providing capacitive coupling between all the first to third resonators and by setting the resonance frequencies of the first and second resonators to be equal and higher than that of the third resonator. The other two attenuation poles at lower frequencies are formed by addition of C40, C50, and C60 in the equivalent circuit of FIG. 12. The graph of FIG. 21 shows that the bandpass filter has good transmission characteristics in which a flat and very wide passband ranging from about 2.3 GHz to 3 GHz is achieved, an attenuation pole is formed near the lower frequencies of the passband, and a sufficient attenuation is obtained near the lower frequencies of the passband. These results have proven the effectiveness of the present invention.

REFERENCE SIGNS LIST

10: laminated body
11: dielectric layer
21*a*, 21*b*: ground electrode
31*a*: first resonance electrode
31*b*: second resonance electrode
31*c*: third resonance electrode
40*a*: first input/output coupling electrode
40*b*: second input/output coupling electrode
43: resonator coupling electrode
80: wireless communication module
81: baseband unit
82: RF unit
84: antenna
85: wireless communication device
821: bandpass filter

The invention claimed is:

1. A bandpass filter comprising:

a laminated body formed by stacking a plurality of dielectric layers;

a ground electrode disposed on at least one of an upper surface and a lower surface of the laminated body;

first to third resonance electrodes having a strip shape and sequentially arranged side-by-side, as viewed in a direction substantially orthogonal to the laminated body, on a same interlayer or different interlayers of the laminated body such that the first to third resonance electrodes are electromagnetically coupled to each other, the first to third resonance electrodes being grounded at one end and constituting first to third resonators, respectively;

a first input/output coupling electrode having a strip shape and disposed in an interlayer of the laminated body, the interlayer being different from the interlayer where the first resonance electrode is disposed, such that the first input/output coupling electrode faces the first resonance electrode and is electromagnetically coupled thereto;

a second input/output coupling electrode having a strip shape and disposed in an interlayer of the laminated body, the interlayer being different from the interlayer where the second resonance electrode is disposed, such that the second input/output coupling electrode faces the second resonance electrode and is electromagnetically coupled thereto; and a resonator coupling electrode disposed in an interlayer of the laminated body, the interlayer being different from both the interlayer where the first resonance electrode is disposed and the interlayer where the third resonance electrode is disposed, and configured to provide electromagnetic coupling between the first resonance electrode and the third resonance electrode, wherein the resonator coupling electrode is connected to the first resonance electrode by electromagnetic coupling, and is connected to the third resonance electrode using a feedthrough conductor, the first and second resonators have a same resonance frequency which is different from a resonance frequency of the third resonator; and the first to third resonators are used to produce a passband.

2. The bandpass filter according to claim 1, wherein the first to third resonance electrodes are disposed in the same interlayer of the laminated body.

3. The bandpass filter according to claim 1, wherein the ground electrode is disposed on the lower surface of the laminated body;

the first and third resonance electrodes are spaced side-by-side on said same interlayer of the laminated body; and the second resonance electrode is disposed in said different interlayers of the laminated body, said different interlayers being above said same interlayer, such that the second resonance electrode is located between the first and third resonance electrodes as viewed in the direction substantially orthogonal to the laminated body.

4. The bandpass filter according to claim 1, wherein the first to third resonance electrodes are disposed such that the grounded ends thereof are inter-digitally arranged as viewed in the direction substantially orthogonal to the laminated body, the first resonance electrode and the third resonance electrode are electromagnetically coupled mainly capacitively to each other through the resonator coupling electrode, and the resonance frequency of the first and second resonators is set to be higher than the resonance frequency of the third resonator.

5. The bandpass filter according to claim 1, wherein the first to third resonance electrodes are disposed such that the grounded ends thereof are inter-digitally arranged as viewed in the direction substantially orthogonal to the laminated body, the first resonance electrode and the third resonance electrode are electromagnetically coupled mainly inductively to each other through the resonator coupling electrode, and the resonance frequency of the first and second resonators is set to be lower than the resonance frequency of the third resonator.

6. A wireless communication module comprising an RF unit including the bandpass filter according to claim 1; and a baseband unit connected to the RF unit.

7. A wireless communication device comprising an RF unit including the bandpass filter according to claim 1; a baseband unit connected to the RF unit; and an antenna connected to the RF unit.

* * * * *